US005987696A

United States Patent [19]

Wang

[11] Patent Number: 5,987,696

[45] Date of Patent: Nov. 23, 1999

[54] CARPET CLEANING MACHINE

[76] Inventor: Kevin W. Wang, 1525 Endeavor Pl. Suite O, Anaheim, Calif. 92801

[21] Appl. No.: 08/774,088

[22] Filed: Dec. 24, 1996

[51] Int. Cl.[6] ..... A47L 9/28

[52] U.S. Cl. ..... 15/319; 15/321

[58] Field of Search ..... 15/321, 339, 319

[56] References Cited

U.S. PATENT DOCUMENTS

| | | | |
|---|---|---|---|
| 4,654,924 | 4/1987 | Getz et al. | 15/319 |
| 4,667,364 | 5/1987 | Meili | 15/319 X |
| 4,958,406 | 9/1990 | Toyashima et al. | 15/319 |
| 5,233,682 | 8/1993 | Abe et al. | 15/319 X |
| 5,265,305 | 11/1993 | Kraft et al. | 15/319 |
| 5,301,385 | 4/1994 | Abe et al. | 15/319 |
| 5,381,584 | 1/1995 | Jyoraku et al. | 15/319 |
| 5,548,511 | 8/1996 | Bancroft | 15/319 X |
| 5,555,595 | 9/1996 | Ligman | 15/321 X |
| 5,613,271 | 3/1997 | Thomas | 15/321 |
| 5,657,509 | 8/1997 | Trautloff et al. | 15/321 |

FOREIGN PATENT DOCUMENTS 2 243 992 11/1991 United Kingdom .

*Primary Examiner*—Chris K. Moore

*Attorney, Agent, or Firm*—Robert D. Fish; Crokett & Fish

[57] ABSTRACT

A microprocessor is used to control various components of a carpet cleaning machine to improve its functionality. In various aspects of the invention, the microprocessor is software controlled, and can provide sequential operating instructions to the operator, enforce start-up and shut down sequences, store an electronic record of operating parameters for future use, provide auto—and remote diagnostics, and provide remote control. In another aspect of the invention the microprocessor can affect the operation of the entire system by dynamically controlling the speed of the motor. In another aspect of the invention, a more effective muffler can be attached to the exhaust of the motor, thereby greatly reducing the noise level. In still other aspects of the invention, the microprocessor can operate an ignition kill switch to the motor, solenoid and/or clutch controls for the fluid and air pumps, an energy cutoff switch for the heater, and software updates via modem.

12 Claims, 14 Drawing Sheets

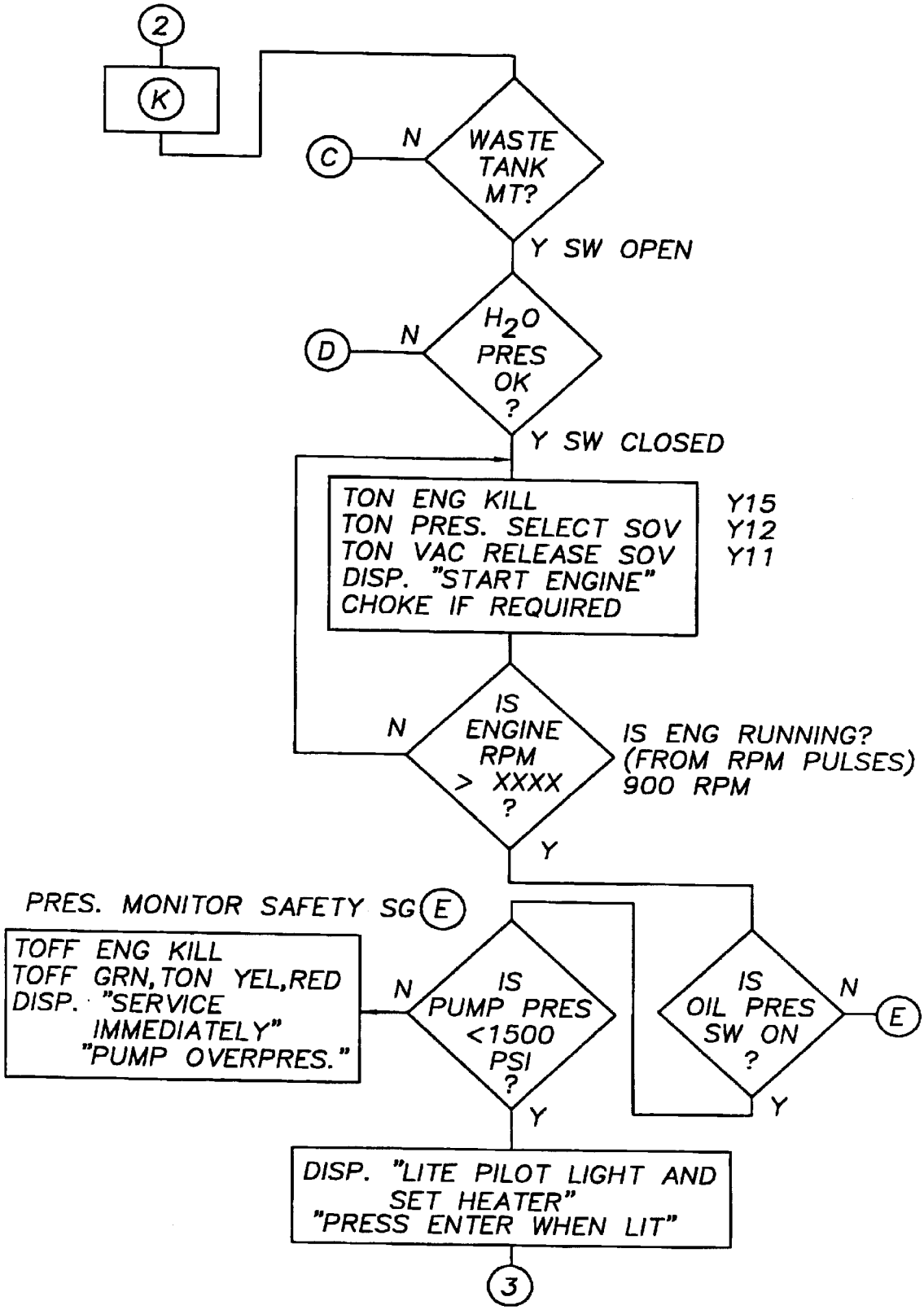
2
K
C
N
WASTE TANK MT?
Y SW OPEN
D
N
$H_2O$ PRES OK ?
Y SW CLOSED
TON ENG KILL
TON PRES. SELECT SOV
TON VAC RELEASE SOV
DISP. "START ENGINE"
CHOKE IF REQUIRED
Y15
Y12
Y11
N
IS ENGINE RPM > XXXX ?
IS ENG RUNNING? (FROM RPM PULSES) 900 RPM
Y
PRES. MONITOR SAFETY SG
E
TOFF ENG KILL
TOFF GRN, TON YEL, RED
DISP. "SERVICE IMMEDIATELY"
"PUMP OVERPRES."
N
IS PUMP PRES <1500 PSI ?
Y
IS OIL PRES SW ON ?
N
E
Y
DISP. "LITE PILOT LIGHT AND SET HEATER"
"PRESS ENTER WHEN LIT"
3

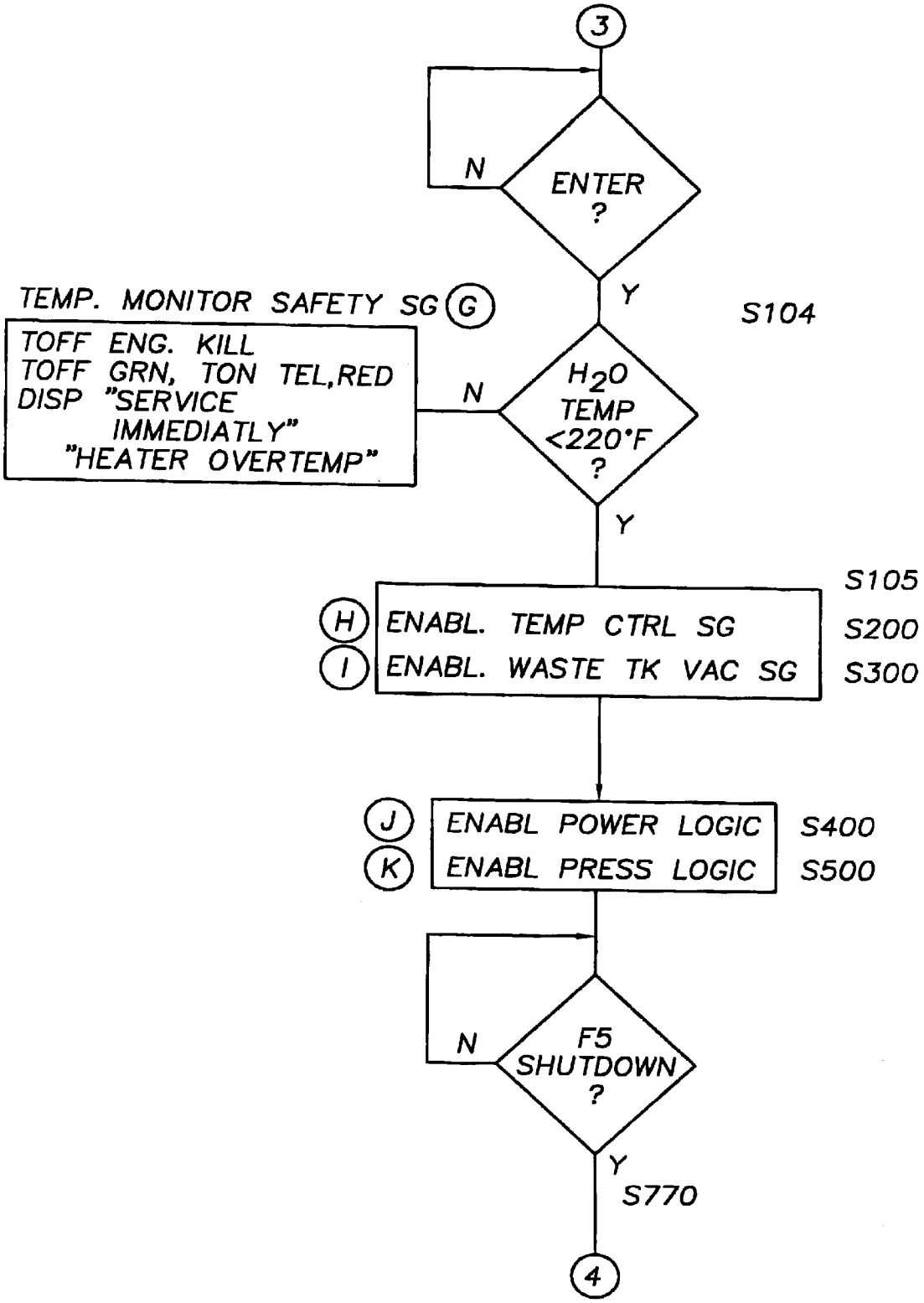
3
ENTER ?
N
Y
S104
TEMP. MONITOR SAFETY SG G
TOFF ENG. KILL
TOFF GRN, TON TEL,RED
DISP "SERVICE IMMEDIATLY"
"HEATER OVERTEMP"
N
$H_2O$ TEMP <220°F ?
Y
S105
H ENABL. TEMP CTRL SG S200
I ENABL. WASTE TK VAC SG S300
J ENABL POWER LOGIC S400
K ENABL PRESS LOGIC S500
N
F5 SHUTDOWN ?
Y
S770
4

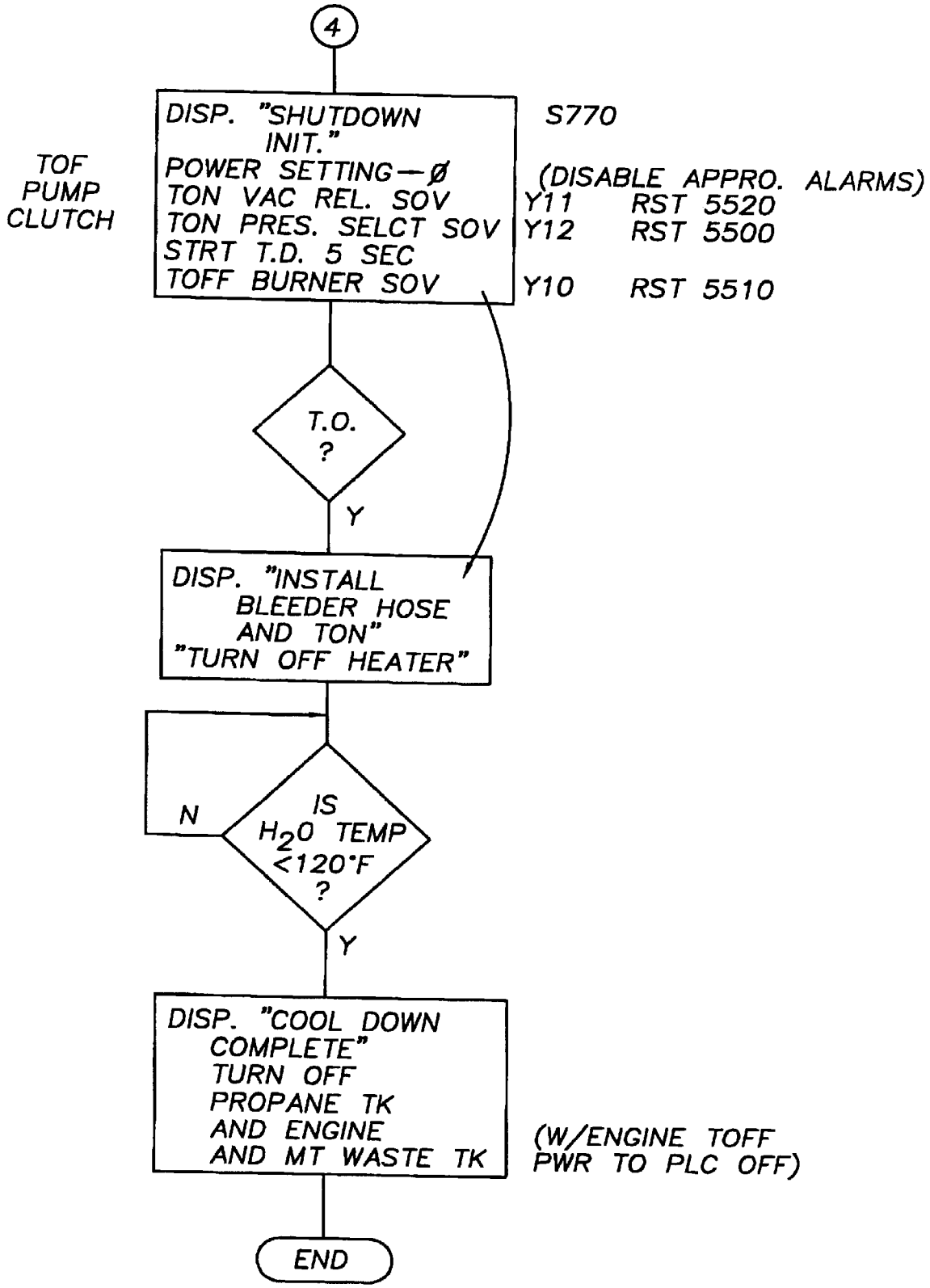
4
DISP. "SHUTDOWN INIT."
S770
TOF PUMP CLUTCH
POWER SETTING—Ø
(DISABLE APPRO. ALARMS)
TON VAC REL. SOV
Y11 RST 5520
TON PRES. SELCT SOV
Y12 RST 5500
STRT T.D. 5 SEC
TOFF BURNER SOV
Y10 RST 5510
T.O. ?
Y
DISP. "INSTALL BLEEDER HOSE AND TON" "TURN OFF HEATER"
N
IS H2O TEMP <120°F ?
Y
DISP. "COOL DOWN COMPLETE" TURN OFF PROPANE TK AND ENGINE AND MT WASTE TK
(W/ENGINE TOFF PWR TO PLC OFF)
END

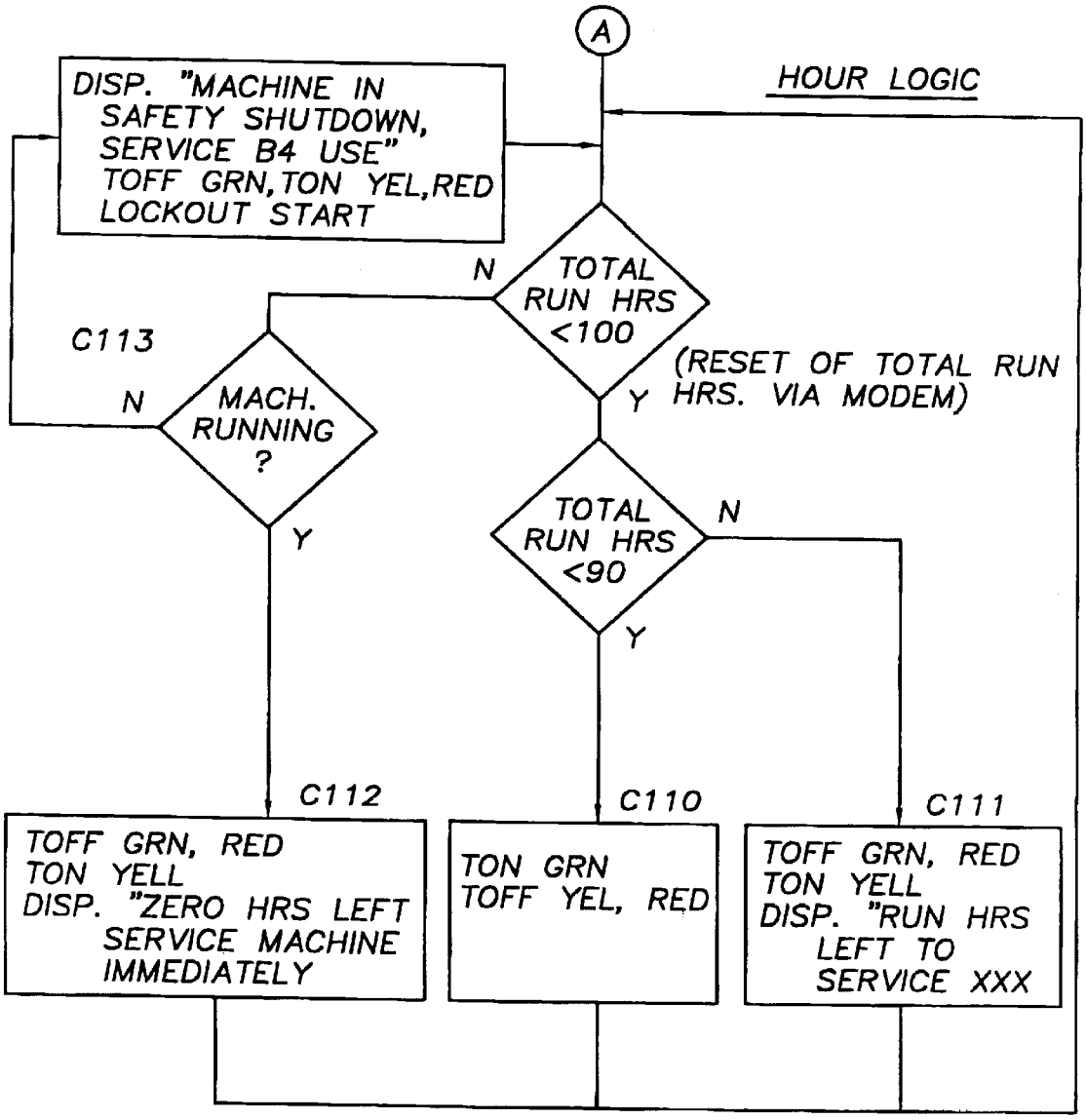
A
HOUR LOGIC
DISP. "MACHINE IN SAFETY SHUTDOWN, SERVICE B4 USE" TOFF GRN, TON YEL, RED LOCKOUT START
TOTAL RUN HRS <100
N
Y
(RESET OF TOTAL RUN HRS. VIA MODEM)
C113
MACH. RUNNING ?
N
Y
TOTAL RUN HRS <90
N
Y
C112
TOFF GRN, RED
TON YELL
DISP. "ZERO HRS LEFT SERVICE MACHINE IMMEDIATELY
C110
TON GRN
TOFF YEL, RED
C111
TOFF GRN, RED
TON YELL
DISP. "RUN HRS LEFT TO SERVICE XXX

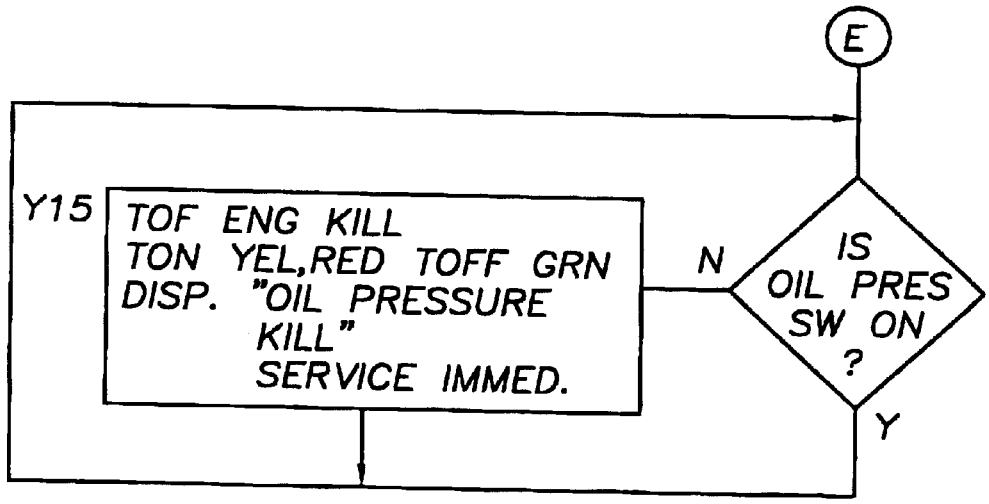
E
Y15
TOF ENG KILL
TON YEL,RED TOFF GRN
DISP. "OIL PRESSURE
KILL"
SERVICE IMMED.
N
IS
OIL PRES
SW ON
?
Y
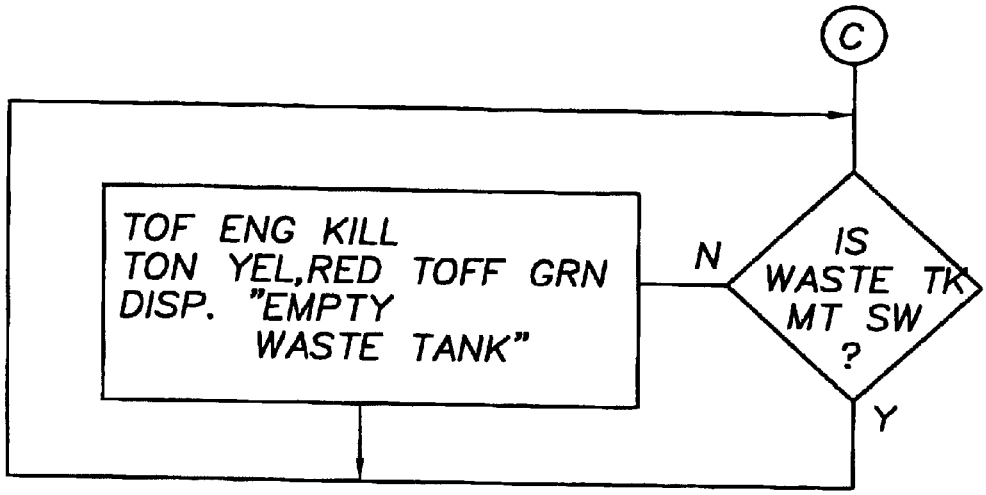
C
TOF ENG KILL
TON YEL,RED TOFF GRN
DISP. "EMPTY
WASTE TANK"
N
IS
WASTE TK
MT SW
?
Y
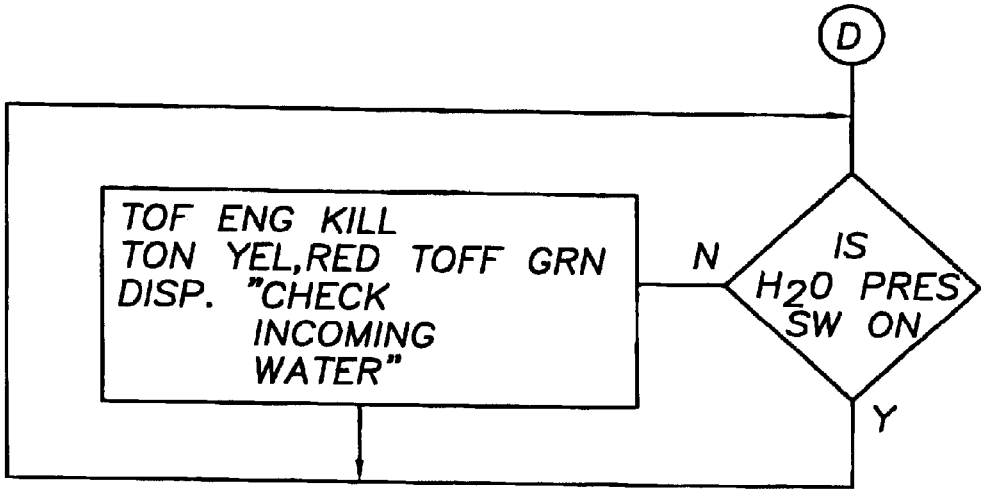
D
TOF ENG KILL
TON YEL,RED TOFF GRN
DISP. "CHECK
INCOMING
WATER"
N
IS
H2O PRES
SW ON
Y

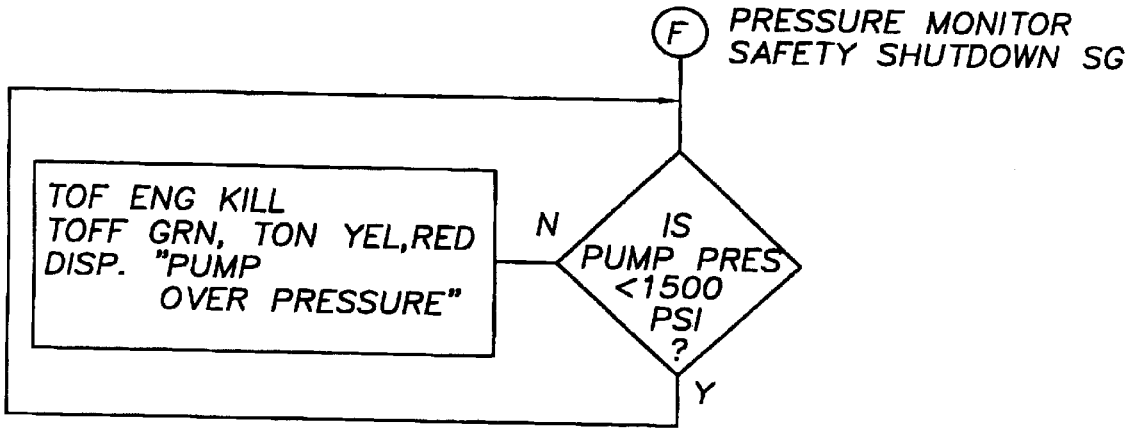
F
PRESSURE MONITOR
SAFETY SHUTDOWN SG
TOF ENG KILL
TOFF GRN, TON YEL,RED
DISP. "PUMP
OVER PRESSURE"
N
IS
PUMP PRES
<1500
PSI
?
Y
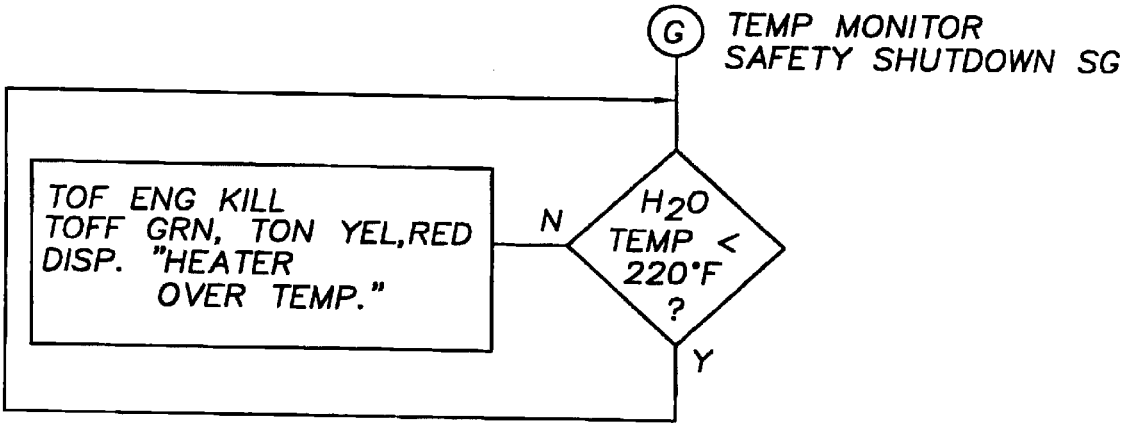
G
TEMP MONITOR
SAFETY SHUTDOWN SG
TOF ENG KILL
TOFF GRN, TON YEL,RED
DISP. "HEATER
OVER TEMP."
N
H2O
TEMP <
220°F
?
Y

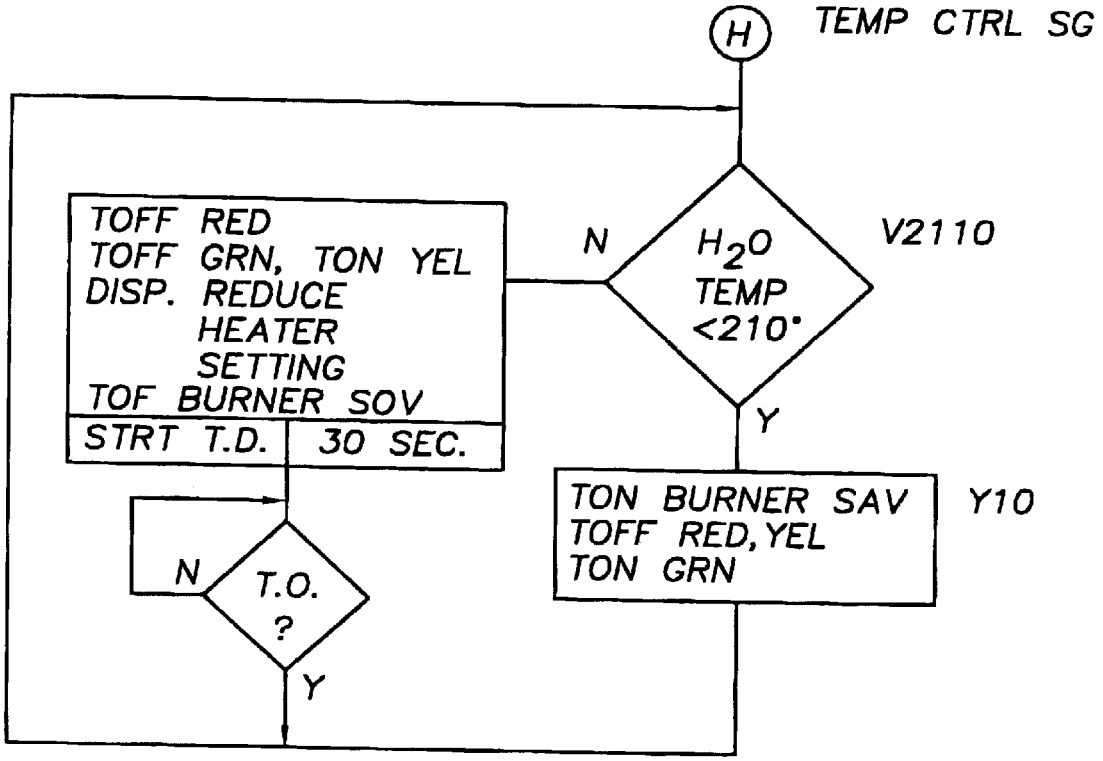
H
TEMP CTRL SG
TOFF RED
TOFF GRN, TON YEL
DISP. REDUCE
HEATER
SETTING
TOF BURNER SOV
STRT T.D.
30 SEC.
N
H2O
TEMP
<210°
V2110
Y
TON BURNER SAV
TOFF RED, YEL
TON GRN
Y10
N
T.O.
?
Y

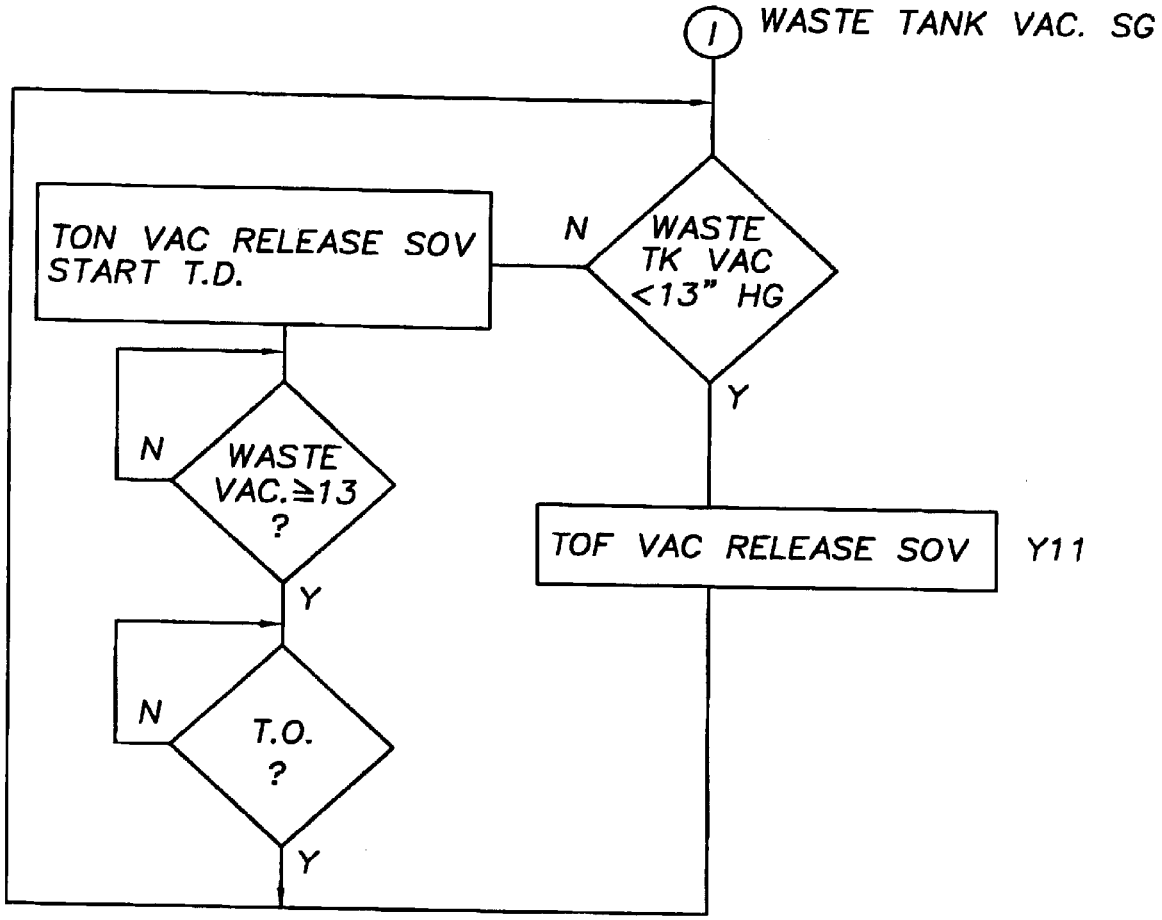
1
WASTE TANK VAC. SG
WASTE TK VAC <13" HG
N
Y
TON VAC RELEASE SOV START T.D.
WASTE VAC.≥13 ?
N
Y
T.O. ?
N
Y
TOF VAC RELEASE SOV
Y11

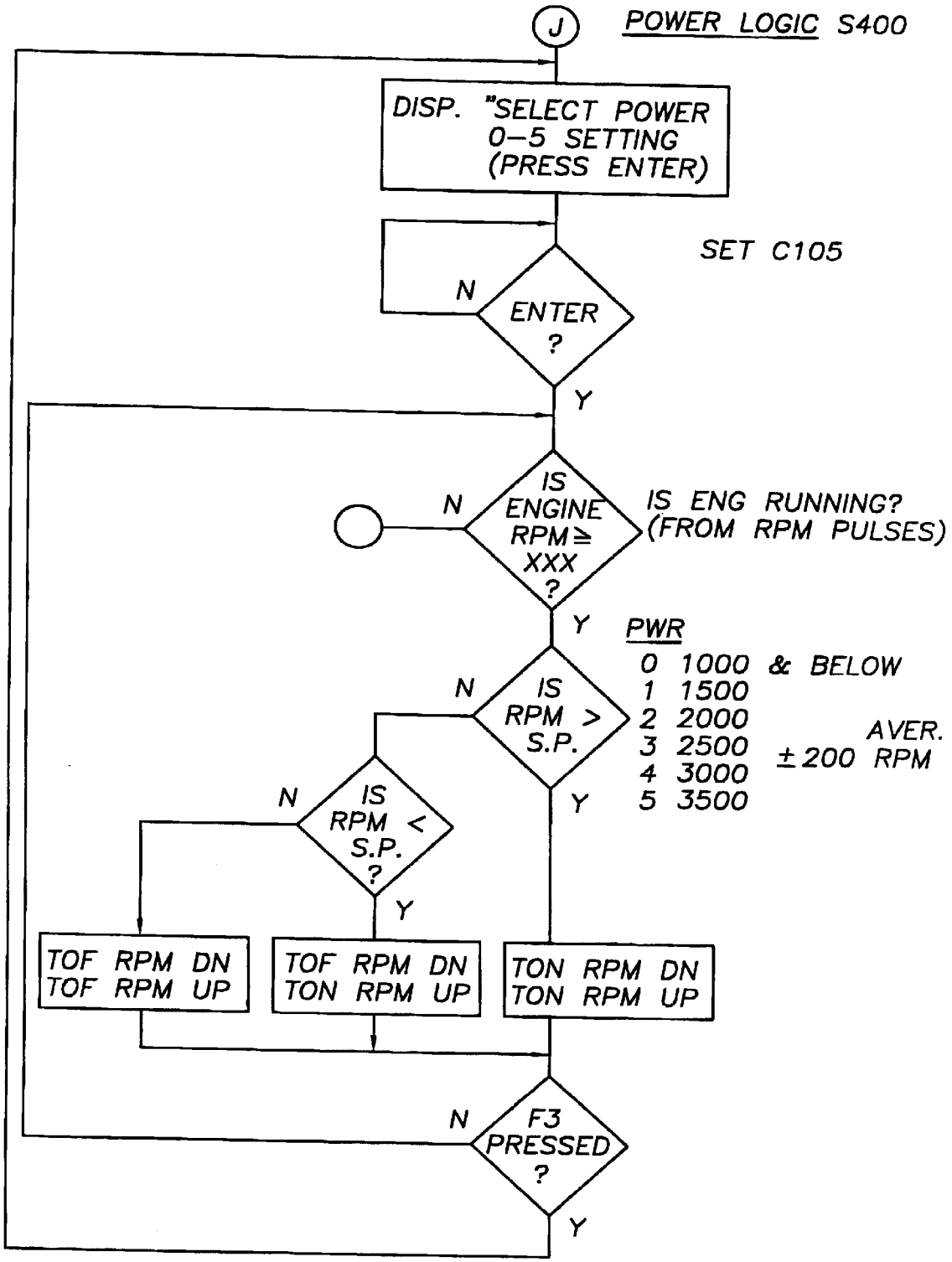
J
POWER LOGIC S400
DISP. "SELECT POWER 0–5 SETTING (PRESS ENTER)
SET C105
ENTER ?
N
Y
IS ENGINE RPM≥ XXX ?
IS ENG RUNNING? (FROM RPM PULSES)
PWR
0 1000 & BELOW
1 1500
2 2000
3 2500
4 3000
5 3500
AVER. ±200 RPM
IS RPM > S.P.
IS RPM < S.P. ?
TOF RPM DN
TOF RPM UP
TOF RPM DN
TON RPM UP
TON RPM DN
TON RPM UP
F3 PRESSED ?

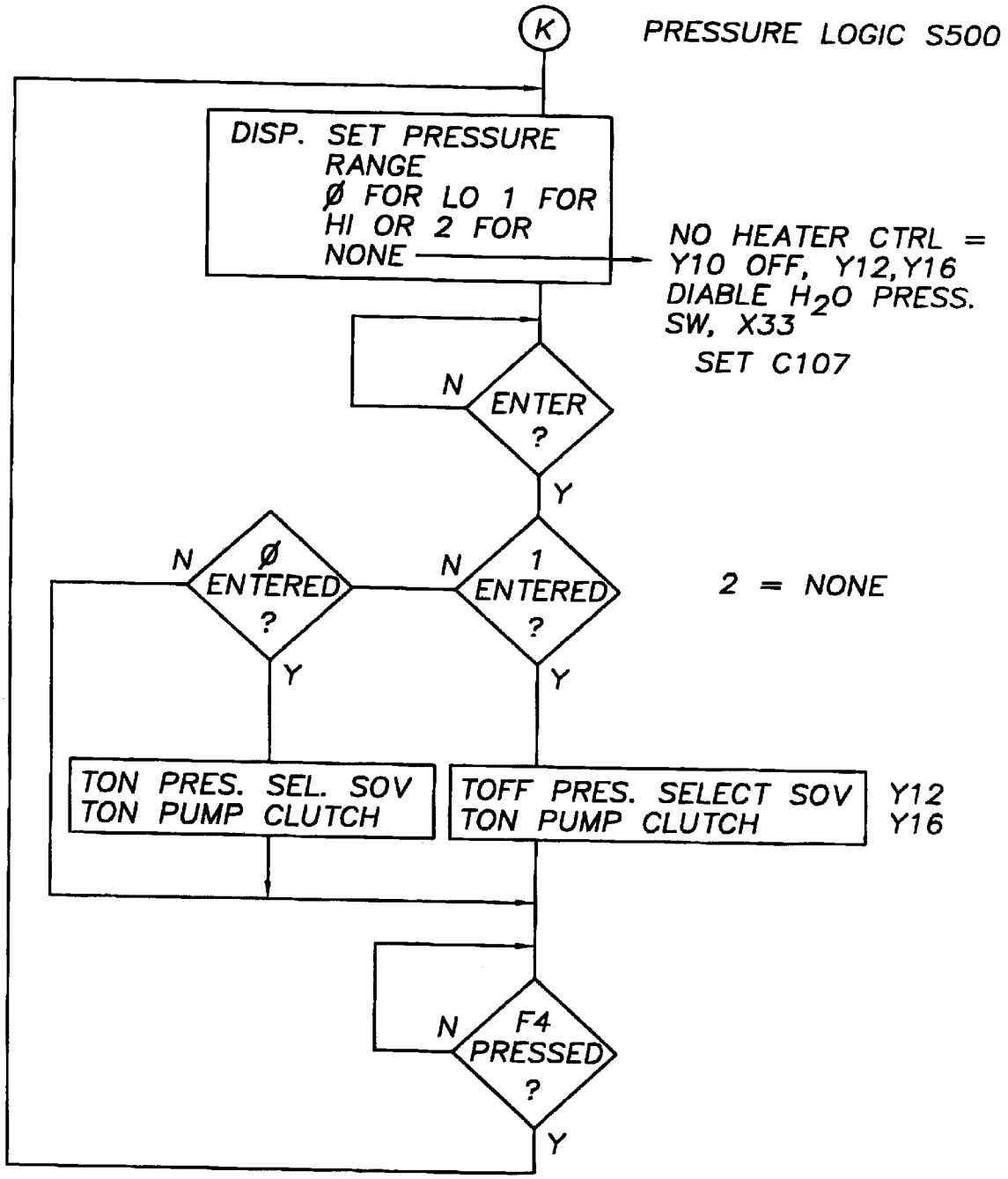
K
PRESSURE LOGIC S500
DISP. SET PRESSURE RANGE Ø FOR LO 1 FOR HI OR 2 FOR NONE
NO HEATER CTRL = Y10 OFF, Y12,Y16 DIABLE H2O PRESS. SW, X33
SET C107
N
ENTER ?
Y
N
Ø ENTERED ?
N
1 ENTERED ?
2 = NONE
Y
Y
TON PRES. SEL. SOV TON PUMP CLUTCH
TOFF PRES. SELECT SOV TON PUMP CLUTCH
Y12 Y16
N
F4 PRESSED ?
Y

CARPET CLEANING MACHINE

I. FIELD OF THE INVENTION

The inventive subject matter herein relates generally to machine cleaning which can be adapted to carpets, drapery, blinds, upholstery and the like.

II. BACKGROUND OF THE INVENTION

Carpets, draperies, blinds, upholstery and the like are often cleaned using steam/hot water systems. Since these units usually operate on similar principles, but at different pressures and with different solvents, they are all generically and interchangeably referred to herein as carpet cleaners, carpet cleaning machines, systems, equipment, units and so on. In general, steam/hot water systems include the same basic components, namely a wand for dispensing and recovering a cleaning fluid, an optional reservoir for holding reserve fluid, a fluid pump for providing pressurized cleaning fluid at the wand, an air pump (sometimes referred to as a vacuum pump) for sucking up spent fluid, and a spent fluid holding tank. Carpet cleaning equipment contemplated herein ranges from relatively small residential units to large, truck mounted units with long hoses reaching from the truck to the surface to be cleaned.

The efficacy of steam/hot water type carpet cleaning equipment is dependent upon many factors, including operator skill and experience, the quality and condition of the machine, the solvents used, the temperature and pressure at which the cleaning fluid is dispensed, and the vacuum with which the cleaning fluid is recovered. Due to the many factors involved, it is not unusual to experience some or all of the following problems. First, an operator may keep his equipment in a poor state of maintenance. For example, the holding tanks may not be emptied regularly, or the equipment may not be serviced regularly. Second, operators tend to push their equipment to the limit, for example by setting the thermostat on the heater at an unsafe level. Third, operators do not necessarily know how to operate the equipment properly. This problem can be addressed to some extent with operator manuals, but such manuals are of little use where the manuals are not available at an operating site, or an operator is unwilling to wade through a manual to find the relevant section. Fourth, operators do not necessarily keep accurate records of operating conditions, so that when an equipment failure occurs it is often almost impossible to pinpoint the cause as being something which is or is not covered by warranty. Fifth, when equipment failures do occur, the equipment may be at a great distance from a suitable repair facility, and individual operators may not have the skills to effectively diagnose the failure.

Even where carpet cleaning equipment is maintained in top shape and is operated properly, a particular machine may not have the capacity required for a particular job. Commonly the heater is inadequate to provide sufficiently hot solvent, or the vacuum pump does not draw a sufficient volume of air to adequately remove spent solvent. Of course, it is not difficult to design ever larger carpet cleaning machines having larger heater and air pumps, but this generally makes the equipment ever larger and noisier. Many truck mounted units are already so loud that their use in residential and even commercial districts is unacceptable.

Thus, there exists a need to improve the operation of carpet cleaning equipment in a manner which can resolve the above mentioned problems, and there is nothing in the art which teaches or suggests how that can be accomplished. UK patent application GB 2,243,992 (the '992 application), for example, discloses a carpet cleaning machine which incorporates a microprocessor, but that microprocessor is not used to improve the operation of the equipment. Instead, the '992 application only uses the microprocessor as a safety switching mechanism, to distance the operator from the high voltage switches connected to the various pumps. Other patents such as U.S. Pat. No. 5,075,921 are directed to a particular component of a carpet cleaning system, but do not address the problems set forth above.

III. SUMMARY OF THE INVENTION

Methods and apparatus are provided in which a microprocessor controls various components of a carpet cleaning machine to improve its functionality.

In various aspects of the invention, the microprocessor is software controlled, and can provide sequential operating instructions to the operator, enforce start-up and shut down sequences, store an electronic record of operating parameters for future use, provide auto—and remote diagnostics, and provide remote control. In another aspect of the invention the microprocessor can affect the operation of the entire system by dynamically controlling the speed of the motor. In another aspect of the invention, a more effective muffler can be attached to the exhaust of the motor, thereby greatly reducing the noise level. In still other aspects of the invention, the microprocessor can operate an ignition kill switch to the motor, solenoid and/or clutch controls for the fluid and air pumps, an energy cutoff switch for the heater, and software updates via modem.

Various objects, features, aspects and advantages of the present invention will become more apparent from the following detailed description of preferred embodiments of the invention, along with the accompanying drawings in which like numerals represent like components.

IV. BRIEF DESCRIPTION OF THE DRAWINGS

V. DETAILED DESCRIPTION

Figure 1:
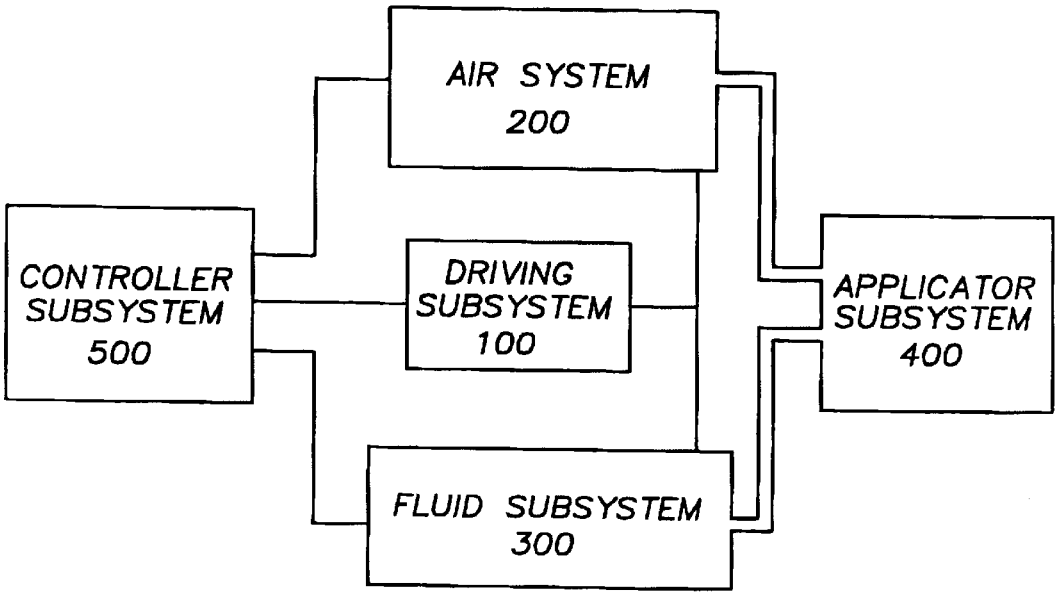
FIG. 1 is a schematic of a preferred carpet cleaning machine according to the disclosure herein.

FIG. 1 generally depicts a carpet cleaning machine 1 comprising a power subsystem 100, an air subsystem 200, a fluid subsystem 300, an applicator subsystem 400 and a controller subsystem 500.

Figure 2:
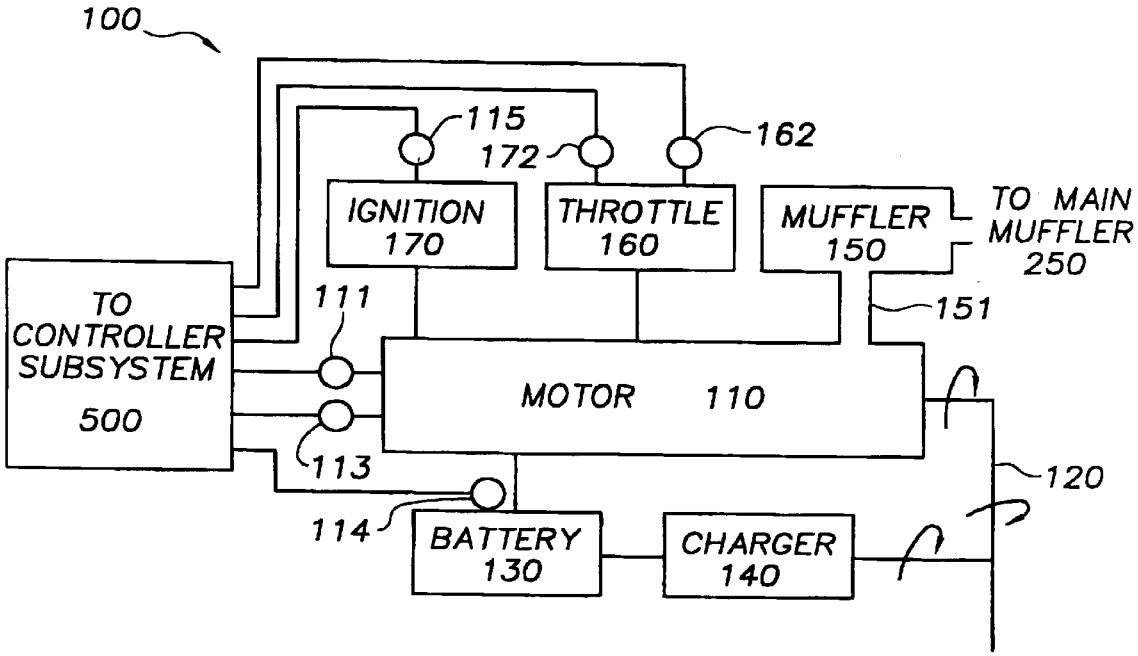
FIG. 2 is a schematic showing details of the driving subsystem of FIG. 1.

Turning to each subsystem in greater detail, FIG. 2 depicts additional details of the driving subsystem 100, which comprises a motor 110, a drive train 120 a battery 130, a charging circuit 140, a motor muffler 150, a throttle 160 and an ignition 170.

The motor 110 is preferably an overhead cam Kohler™ gasoline engine, although engines from other manufacturers may function as well, and other types of engines such as propane, diesel or electric would also work. It is contemplated that the motor 110 would range from about 16 hp to about 50 hp, with a preferred rating of about 25 hp. The motor speed is also not critical, as long as the motor 110 can be geared to provide a rotational speed to the air pump of at least about 900 rpm. A preferred speed of the motor is 3600 rpm.

The preferred driving subsystem 100 has four sensors, a speed sensor 111, a throttle position sensor 112, an oil pressure sensor 113 and a subsystem voltage sensor 114. The sensors are all standard units and their connections and operation are well within the ordinary skill in the art.

The driving subsystem 100 also has two effectors, a throttle controller 162 and an ignition kill switch 172. The throttle controller 162 is preferably a Dayton 12 volt DC gear motor model 2L004, although many other throttle controllers would also be satisfactory. The ignition kill switch 172 is once again any standard unit, and is connected and operated in an ordinary manner.

Figure 3:
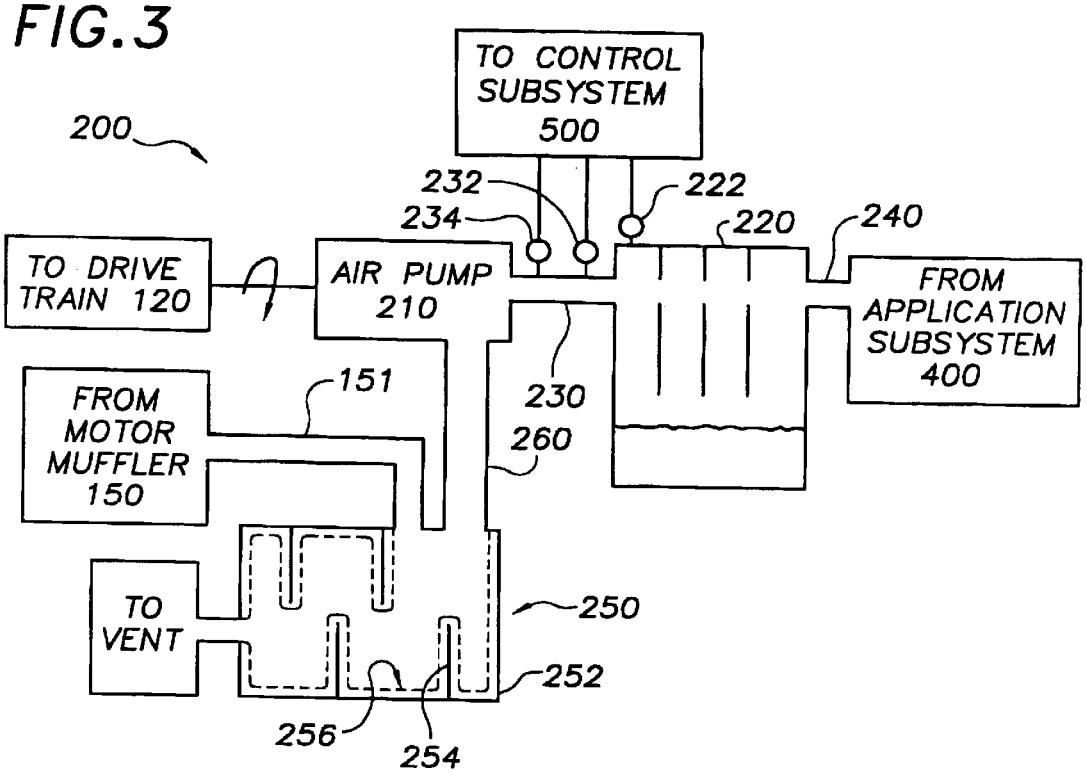
FIG. 3 is a schematic showing details of the fluid subsystem of FIG. 1.

FIG. 3 generally depicts additional details of the air subsystem 200, including an air pump 210, a spent fluid storage tank 220, a vacuum line 230 connecting the air pump 210 and the spent fluid storage tank 220, and an incoming line 240 from the applicator subsystem 400.

The preferred air pump 210 is a Roots™ Universal RAI model 47 positive displacement rotary lobed blower designed to operate at 3600 RPM. This matches the nominal operating speed of the motor 110 so that a conversion box can be eliminated. It is not necessary for the air pump to provide a near perfect vacuum, and the preferred pump can achieve approximately 15" Hg. Of course, other types and makes of pumps may also be suitable.

FIG. 3 also includes a main muffler 250 which is connected to air pump 210 via line 260. The preferred design comprises a large stainless steel metal box 252 measuring about 5" by about 20", with offset baffles 254 covered with foam 256, and having passageways between the baffles of approximately 3" by 18". The preferred foam is Technifoam TFX-1.5" flat Melomyn, although other foams could also be used, including foams with pyramidal or other projections. Fiberglass is to be avoided as a foam replacement because it tends to become wetted, which then greatly diminishes its sound deadening qualities. Line 260 pneumatically coupling the air pump 210 and the muffler 250 is preferably about 3" in inside diameter. There is also a pipe 151 from the exhaust of the motor muffler 150, which is about 1" in inside diameter. The main muffler 250 of this design can handle about 500 $ft^3$/min.

The air subsystem 200 has a vacuum sensor 232 coupled to the vacuum line 230, and a fluid level sensor 222 coupled to the spent fluid storage tank 220. These sensors are all standard units, the operation of which is well within the ordinary skill of the art.

The air subsystem 200 also includes a vacuum relief 234, which can comprise an ordinary spring actuated valve, but which advantageously comprises a solenoid operated valve controlled by the control subsystem 500. There are numerous advantages to this feature. In particular, spring operated relief valves are inherently inefficient because they open well below their rated relief threshold. For example, in a vacuum line of a typical carpet cleaning machine, it is usually desirable to keep the vacuum at no more than 14" Hg to prevent damage to the motor, air pump and spent fluid storage tank. A spring operated vacuum relief valve nominally rated at 14" Hg will be almost 50% open at 7.5" Hg, thereby wasting a significant amount of energy, and requiring a relatively large motor and air pump. In a preferred embodiment, however, the control subsystem 500 receives signals from the vacuum sensor 232, and controls the solenoid (not shown) of vacuum relief 234, which operates a gate valve (not shown) to maintain the vacuum at about 14" Hg. This allows the motor and air pump to be much smaller than would otherwise be required, and/or permits additional wands to be used simultaneously with a given size motor and air pump.

Figure 4:
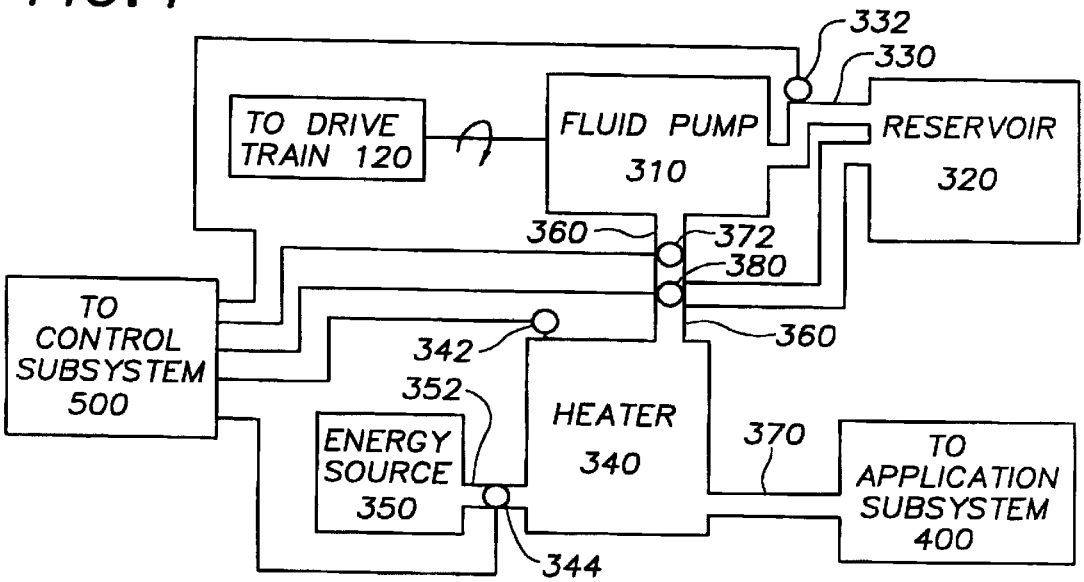
FIG. 4 is a schematic showing details of the applicator subsystem of FIG. 1.

FIG. 4 generally depicts additional details of the fluid subsystem 300, which comprises a fluid pump 310, a clean fluid reservoir 320, a line 330 connecting the fluid pump 310 and clean fluid reservoir 320, a heater 340 with energy source 350 connected via line 352, a line 360 connecting the fluid pump 310 and the heater 340, and an outgoing line 370 to the applicator subsystem 400.

The preferred fluid pump 310 is a positive displacement Hypro™ model 2345B, which is rated at 4.8 gallons per minute and up to 1500 psi. Of course, other fluid pumps may also be satisfactory provided they can provide pressures within the 500 to 3000 psi including the Cat™ or Giant™ pumps commonly used in the industry.

The fluid subsystem 300 has a low side fluid pressure sensor 332, a high side fluid pressure sensor 372, and a heater temperature sensor 342. The fluid subsystem 300 also has a high side pressure controller 380 (See FIG. 5), an electronic clutch 312, and a heater shut off solenoid 342. Except for the high side pressure controller 380, these are all standard units.

Figure 5:
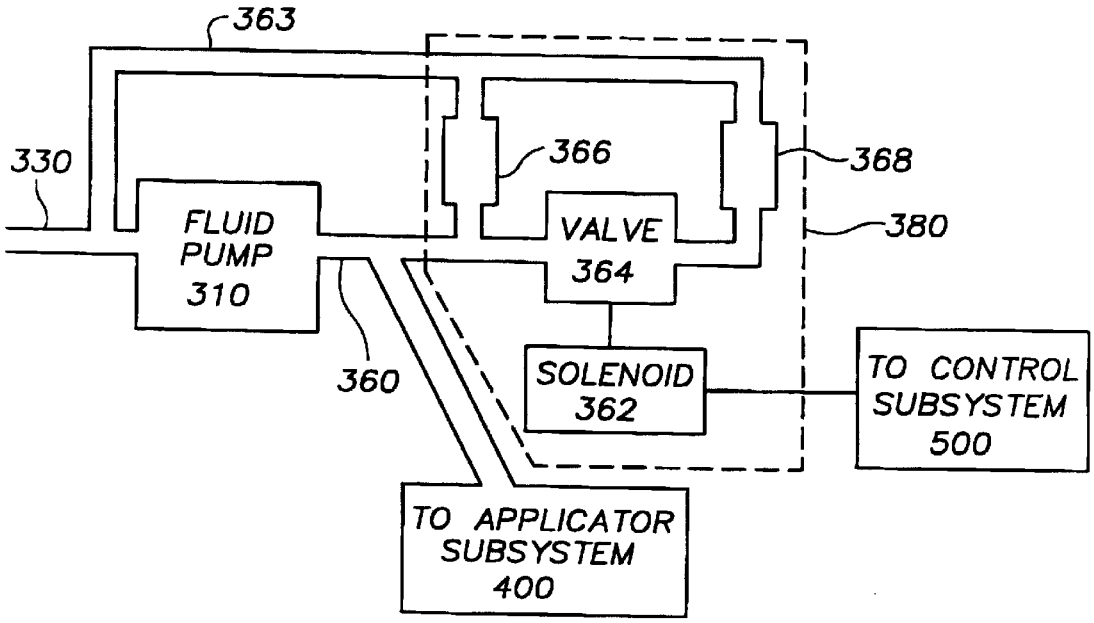
FIG. 5 is a schematic of a preferred pressure regulator arrangement.

FIG. 5 shows a preferred high side pressure controller 380 in which a solenoid 362 controlled valve 364 selects between two different pressures. In this arrangement, both first and second pressure relief valves 366, 368 couple the high side pressure line 360 with the low side pressure line 330 via shunt 363. Assuming that the set point of pressure relief valve 364 is higher than the set point of pressure relief valve 366, then the pressure fed to the applicator subsystem 400 will match the set point of relief valve 366 when value 364 is closed, and will match the set point of relief valve 368 when valve 364 is open. The preferred pressure regulator is a Suttner™ model ST230. The dual set point high side pressure controller 380 is advantageous because it allows convenient electronic switching between two different pressures suited for different applications. A preferred pressure for cleaning upholstery, for example, may be about 20 to about 200 psi while preferred pressures for cleaning carpet range from about 50 to about 700 psi The applicator subsystem 400 (not shown in detail) can be one of many different designs. Typically the applicator subsystem includes a wand with hand trigger control(s) at one end and an adapter at the other end. The adapter typically includes spray jets, suction ports, and a hood. Optional features include articulations or pivots, wheels and the like. It is contemplated that the applicator subsystem 400 may include a plurality of application specific wands, with different wands being especially suited to different carpets, draperies, blinds, upholstery, or other applications.

Figure 6:
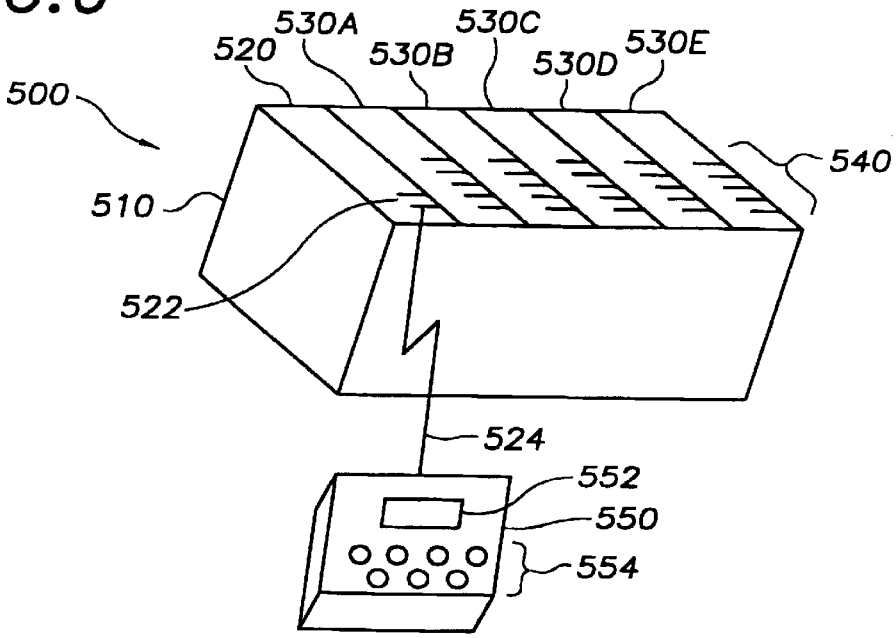
FIG. 6 is a perspective view of the controller subsystem of FIG. 1.

FIG. 6 generally depicts additional details of the controller subsystem 500, which comprises a base 510 connecting a CPU module 520 with a plurality of slots containing plug-in modules 530A, 530B etc. Connectors 540 on the various modules 530 are wired to the various sensors and effectors described above through wires (not shown in FIG. 6) and through appropriate analog/digital and counter interfaces (not shown). Of course, the specific type of base 510 and modules 520, 530, the specific location of the modules

520, 530 within the base 510, and the specific wiring of the connectors can occur in many different permutations, all of which are well within the skill in the art when taken in conjunction with the teachings herein.

A preferred subsystem was built using a 6 slot base W/12/24VDC by Koyo™ as the base and power supply. The preferred system contains a CPU module 520 which has a microprocessor (not shown), 2 serial ports 522, a CPU battery (not shown), RAM and ROM memory (not shown) into which is loaded the software (not shown) for operating the subsystem. The preferred system plug-in modules 530 are a 12–24 VDC input module, a 5–30 VDC isolated relay out, a 4–20 mA analog input module, a 5K Hz counter input module, and a filler module, all of which are also available from Koyo™.

FIG. 6 also depicts a user interface 550 which includes an LCD display 552 and a plurality of data entry keys 554. The preferred display 552 is a 2×40 4 line display by Optimizer™. The user interface 550 is coupled to at least one of the serial ports 522 via cable 524.

Figure 7:
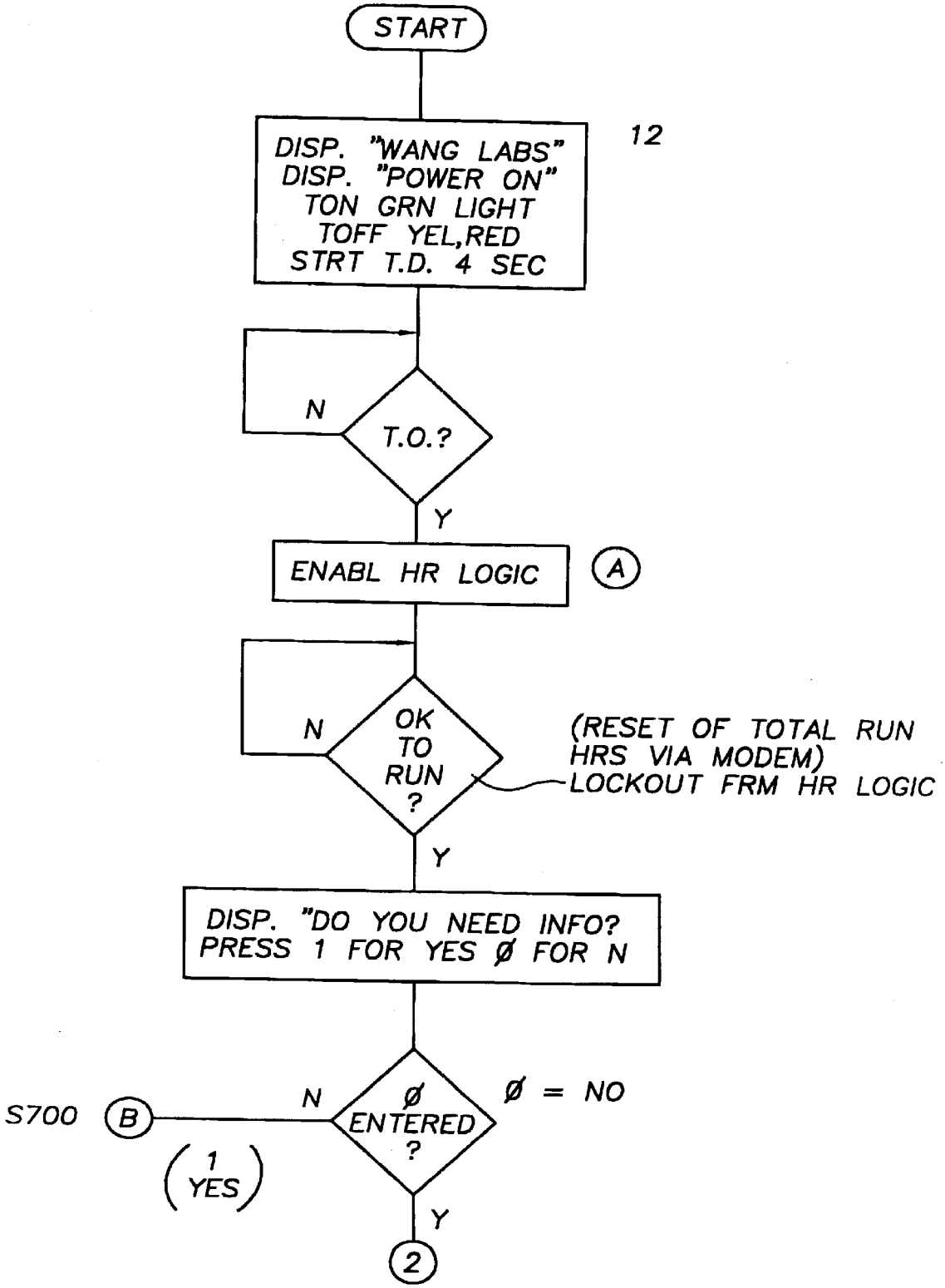
FIG. 7 is a flow chart of the logic embedded in a preferred software embodiment.

FIG. 7 depicts the logic of the preferred software. As with the hardware, the actual implementation of the software can take innumerable different forms within the inventive concepts taught herein. The software flow sheet of FIG. 7 is self explanatory.

Thus, various aspects of improved carpet cleaning machines have been disclosed. While specific embodiments and applications have been shown and described, it would be apparent to those skilled in the art that many more modifications are possible without departing from the inventive concepts herein. The invention, therefore, is not to be restricted except in the spirit of the appended claims.

What is claimed is:

1. A carpet cleaning machine comprising:

a cleaning wand providing an air flow having a suction force and a cleaning fluid having a pressure; and a microprocessor controlling at least one of the suction force, and fluid pressure provided by the wand.

2. The machine of claim 1 further comprising a fluid pump wherein the fluid pump provides the cleaning fluid to the cleaning wand; and the microprocessor controls the fluid pressure of the cleaning fluid provided by the fluid pump.

3. The machine of claim 1 further comprising an air pump wherein the air pump provides the suction force to the cleaning wand; and the microprocessor controls the suction force provided by the air pump.

4. The machine of claim 1 further comprising:

a fluid pump providing the fluid pressure to the cleaning wand;

an air pump providing the suction force to the cleaning wand;

a cleaning fluid reservoir containing the cleaning fluid;

a heater which heats the cleaning fluid in the reservoir to a set point temperature and having a shut-off control; and the microprocessor controlling at least two of: (a) the fluid pressure provided by the fluid pump; (b) the suction force provided by the air pump; and (c) the shut-off control of the heater.

5. The machine of claim 1 further comprising:

a fluid pump providing the fluid pressure to the cleaning wand;

an air pump providing the suction force to the cleaning wand;

a cleaning fluid reservoir containing the cleaning fluid;

a heater which heats the cleaning fluid in the reservoir to a set point temperature and having a shut-off control; and the microprocessor controlling: (a) the fluid pressure provided by the fluid pump; (b) the suction force provided by the air pump; and (c) the shut-off control of the heater.

6. The machine of claim 1 further comprising:

a fluid pump providing the fluid pressure to the cleaning wand;

an air pump providing the suction force to the cleaning wand;

the microprocessor dynamically controlling (a) the fluid pressure provided by the fluid pump and (b) the suction force provided by the air pump in response to an operation of the cleaning wand.

7. The machine of claim 1 further comprising a software based logic directing the microprocessor.

8. The machine of claim 7 further comprising a motor having a controllable speed, wherein the software based logic directs the microprocessor to control the speed of the motor, the fluid pressure and the suction force.

9. The machine of claim 7 further comprising a motor having an on/off switch, wherein the software based logic directs the microprocessor to control the on/off switch of the motor.

10. The machine of claim 7 furtherer comprising a fluid pump wherein the fluid pump has at least one of a solenoid control and a clutch control, wherein the software based logic directs the microprocessor to control the at least one of the solenoid control and clutch control of the fluid pump.

11. The machine of claim 7 further comprising an air pump wherein the air pump has a solenoid control, and the software based logic directs the microprocessor to control the solenoid control of the air pump.

12. The machine of claim 7 further comprising a fluid pump an air pump, and a motor having an on/off switch, the fluid pump having at least one of a solenoid control and a clutch control, and the air pump having a solenoid control, wherein the software based logic directs the microprocessor to control the on/off switch of the motor, the at least one of the solenoid control and clutch control of the fluid pump, and the solenoid control of the air pump.

* * * * *